United States Patent [19]

Norman et al.

[11] Patent Number: 4,999,119

[45] Date of Patent: Mar. 12, 1991

[54] ALCOHOL RESISTANT AQUEOUS FILM FORMING FIREFIGHTING FOAM

[75] Inventors: Edward C. Norman, Chester Springs; Anne C. Regina, Coatesville, both of Pa.

[73] Assignee: Chubb National Foam, Inc., Lionville, Pa.

[21] Appl. No.: 383,141

[22] Filed: Jul. 20, 1989

[51] Int. Cl.[5] ..... A62D 1/02; A62D 1/04

[52] U.S. Cl. ..... 252/3; 252/8.05

[58] Field of Search ..... 252/3, 8.05

[56] References Cited

U.S. PATENT DOCUMENTS

| | | | |
|---|---|---|---|
| 3,772,269 | 11/1973 | Lew | 260/210 |
| 4,060,489 | 11/1977 | Chiesa, Jr. | 252/3 |
| 4,387,032 | 6/1983 | Chiesa, Jr. | 252/3 |
| 4,424,133 | 1/1984 | Mulligan | 252/8.05 |
| 4,439,329 | 3/1984 | Kleiner et al. | 252/8.05 |
| 4,565,647 | 1/1986 | Llenado | 252/3 |
| 4,859,349 | 8/1989 | Clark et al. | 252/3 |

*Primary Examiner*—Robert L. Stoll
*Assistant Examiner*—Joseph D. Anthony
*Attorney, Agent, or Firm*—Samuels, Gauthier & Stevens

[57] ABSTRACT

AFFF and ARAFFF firefighting foam concentrates which include alkyl polyglycoside surfactants. These surfactants enhance the performance of the perfluoroalkyl surfactants.

11 Claims, No Drawings

ALCOHOL RESISTANT AQUEOUS FILM FORMING FIREFIGHTING FOAM

BACKGROUND AND BRIEF SUMMARY OF THE INVENTION

Firefighting foam concentrates are mixtures of foaming agents, solvents and other additives. These concentrates are intended to be mixed with water usually at either a 3 or 6% concentration, the resulting solution is then foamed by mechanical means and the foam is projected onto the surface of a burning liquid.

A particular class of firefighting foam concentrates is known as an aqueous film-forming foam (AFFF). AFFF concentrates have the quality of being able to spread an aqueous film on the surface of hydrocarbon liquids, enhancing the speed of extinguishment. This is made possible by the perfluoroalkyl surfactants contained in AFFF. These surfactants produce very low surface tension values in solution (15–20 dynes $cm^{-1}$) which permits the solution to spread on the surface of the hydrocarbon liquids.

AFFF foams are not effective on water soluble fuels, such as alcohols and the lower ketones and esters, as the foam is dissolved and destroyed by the fuel. There is a sub-class of AFFF foam concentrates known as alcohol resistant AFFF (ARAFFF). ARAFFF concentrates contain a water soluble polymer that precipitates on contact with a water soluble fuel providing a protective layer between the fuel and the foam. ARAFFF foams are effective on both hydrocarbons and water soluble fuels.

Typical AFFF concentrates contain one or more perfluoroalkyl surfactants which may be anionic, cationic, non-ionic or amphoteric, one or more non-fluorinated surfactants which may be anionic, cationic, amphoteric or nonionic, solvents such as glycols and/or glycol ethers and minor additives such as chelating agents, pH buffers, corrosion inhibitors and the like. Many U.S. Patents have disclosed such compositions, such as U.S. Pat. Nos. 3,047,619; 3,257,407; 3,258,423; 3,562,156; 3,621,059; 3,655,555; 3,661,776; 3,677,347; 3,759,981; 3,772,199; 3,789,265; 3,828,085; 3,839,425; 3,849,315; 3,941,708; 3,95,075; 3,957,657; 3,957,658; 3,963,776; 4,038,198; 4,042,522; 4,049,556; 4,060,132; 4,060,489; 4,069,158; 4,090,976; 4,099,574; 4,149,599; 4,203,850; and 4,209,407.

ARAFFF concentrates are essentially the same as AFFF's, only with the addition of a water soluble polymer. These compositions are disclosed in U.S. Pat. No. 4,060,489; U.S. Pat. No. 4,149,599 and U.S. Pat. No. 4,387,032.

A common element in all AFFF and ARAFFF compositions is the perfluoroalkyl surfactant. This type of surfactant represents 40–60% of the cost of the concentrate.

We have unexpectedly discovered that by the use of alkyl polyglycoside surfactants it is possible to reduce the necessary concentrations of the perfluoroalkyl surfactants in AFFF compositions by more than 40% without loss of firefighting performance. Similarly, in ARAFFF compositions, the use of alkyl polyglycoside surfactants has produced an unexpected improvement in firefighting performance on water soluble fuels and has made possible the use of less expensive water soluble polymers. The polymer commonly used in ARAFFF compositions is Kelco K8A13, produced by the Kelco Division of Merck and Company. This polymer is believed to be a chemically modified xanthan gum and costs approximately seven (7) times the cost of ordinary industrial grade xantham gum.

Using surfactant systems disclosed in the prior art, it has been impossible to attain satisfactory ARAFFF performance on water soluble fuels with industrial grade xanthan gum without using so high a concentration of the gum that the composition become unacceptably viscous. However, we have discovered that by the inclusion of alkyl polyglycosides as surfactants, ARAFFF compositions using ordinary industrial grade xanthan gum will perform as well as or better than the ARAFFF compositions made with Kelco K8A13 and the surfactant systems disclosed in the past.

Alkyl glycoside and alkyl polyglycosides are known surfactants. A particularly useful class of polyglycosides for purposes of the invention is that marketed by the Horizon Chemical Division of Henkel, Inc. under the tradename "APG".

A typical molecular structure is shown below.

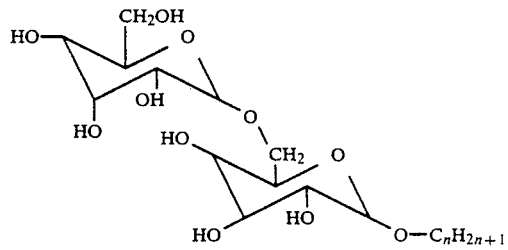

The superior performance of the alkyl polyglycosides in the foam fighting compositions is totally unexpected because of the very low interfacial tension values of alkyl polyglycoside compositions with hydrocarbons. It is normally desirable to use co-surfactant systems with relatively high interfacial tension values to avoid emulsification of fuel in the foam. Exemplary interfacial tension values are set forth below.

TABLE I

| Surfactant | Concentration | Interfacial Tension Mineral Oil |
|---|---|---|
| $C_{12-15}$ Polyglycoside | 0.01% | 0.9 dynes/cm |
| $C_{12}$ Linear alkane sulfonate | 0.01% | 7.2 dynes/cm |
| $C_{12-15}-^{3EO}$ ether sulfate | 0.01% | 7.4 dynes/cm |
| $C_{8-10}$ Imidazoline dicarboxylate (mona CCMM-40) | 0.01% | 15.8 dynes/cm |

Broadly the invention comprises, in one embodiment, an AFFF composition firefighting concentrate comprising a perfluoroalkyl surfactant, a solvent and an effective amount of an alkyl polyglycoside. The invention, in another embodiment, broadly comprises a ARAFFF firefighting concentrate composition having a perfluoroalkyl surfactant, a solvent, a water soluble polymer and an effective amount of an alkyl polyglycoside.

The phrase an effective amount, means the use of the poly alkylglycoside in an amount such that the composition when used as a firefighting concentrate, meets or exceeds those standards which determine the acceptability of the concentrate for firefighting purposes.

DESCRIPTION OF THE PREFERRED EMBODIMENT

The invention comprises an AFFF composition containing an alkyl polyglycoside having the formula:

$$C_nH_{2+1}O(C_6H_{10}O_5)_xH$$

wherein n=4–18 preferably 6–12 and x=1–6 preferably 1–2.

Additionally these compositions preferably contain an amphoteric perfluoroalkyl surfactant of the formula:

$$R_FCH_2CH_2SO_2NHCH_2CH_2CH_2N^+(CH_3)_2CH_2COO^-$$

and/or $$R_FCH_2CH_2SO_2NHCH_2CH_2CH_2N(CH_3)_2\rightarrow O$$

and/or $$C_6F_{13}CH_2CH_2SO_2NHCH_2CH_2CH_2N(CH_3)_2CH_2CH_2COO^-$$

where:

$R_F$ is a perfluoroalkyl chain of the formula $C_nF_{2n+1}$ where n=4 to 18; and an anionic surfactant of the formula:

$$C_nH_{2n+1}OSO_3Na$$

wherein the value of n=8 to 18; and a glycol ether selected from the group consisting of:

1-Butoxy-2-ethanol
1-Ethoxy-2-ethanol
1-Butoxyethoxy-2-ethanol
1-Butoxyethoxy-2-propanol, an a glycol selected from the group consisting of:

1,2 ethanediol
1,2 propanediol
1,3 propanediol
1,3 butanediol
1,4 butanediol; and A nonionic surfactant of the formula

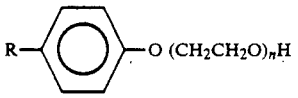

wherein

R=octyl or nonyl and n=2 to 15; and a sequestering agent chosen from salts of ethylene diamine tetraacetic acid and salts of nitrilo-tris acetic acid; and a pH buffer such as Trishydroxymethylaminomethane and/or urea;

The invention further comprises ARAFFF compositions having, in addition to the foregoing, a polysaccharide polymer such as xanthan gum, gum tragacanth, locust bean gum, or guar gum; and a preservative such as orthophenylphenol or dichlorophene.

Relative ranges of the component of the compositions for:

| 3% AFFF | by weight |
|---|---|
| Perfluoroalkyl surfactant | 0.5–3.0%, preferably 0.8–2.6% |
| Magnesium sulfate | 0–1.0%, preferably 0.2–0.6% |
| Glycol | 0–10%, preferably 2.0–7.0% |

-continued

| 3% AFFF | by weight |
|---|---|
| Alkyl polyglycoside surfactant | 1.0–10.0%, preferably 4.0–8.5% |
| Anionic surfactant | 2.0–6.0%, preferably 3.0–5.0% |
| Glycol ether | 4.0–20.0%, preferably 5.0–15.0% |
| Nonionic surfactant | 0.5–2.0%, preferably 0.7–1.5% |
| Sequestering agent | 0–1.0%, preferably 0.1–0.5% |
| Buffering agent | 0–2.0%, preferably 0.5–1.0% |
| Corrosion inhibitors | 0–2.0%, preferably 0.1–0.8% |
| Water | Balance |

It will be recognized by those skilled in the art that AFFF concentrates intended for mixing with water in percentages other than 3% can be made by multiplying the percentage compositions above by the factor 3/x where x represents the desired mixing percentages.

Relative ranges of the composition for:

| ARAFFF for use at 3% on hydrocarbon fuels and at 6% on water soluble fuels | |
|---|---|
| Alkyl polyglycoside surfactant | 1.0–10.0%, preferably 2.0–6.0% |
| Perfluoroalkyl surfactant | 0.8–2.0%, preferably 1.0–1.5% |
| Anionic surfactant | 2.0–5.0%, preferably 2.2–3.5% |
| Glycol ether | 2.0–5.0%, preferably 3.0–4.0% |
| Glycol | 0–5.0%, preferably 0–4.0% |
| Nonionic surfactant | 0 |
| Sequestering agent | 0.1–1.0%, preferably 0.1–0.3% |
| Buffering agents | 0–2.0%, preferably 0–1.7% |
| Magnesium sulfate | 0–1.0%, preferably 0.2–0.7% |
| Polysaccharide | 0.5–1.5%, preferably 0.8–1.0% |
| Water | Balance |

Fire testing

In the examples below, the following tradename ingredients are used.

Forafac 1157N, an amphoteric perfluoroalkyl surfactant, manufactured by Atochem, Inc. a 27% active solution of $R_FCH_2CH_2SO_2NHCH_2CH_2CH_2N^+(CH_3)_2CH_2COO^-$ APG 300 and APG 325CS, 50% active alkyl polyglycosides manufactured by Horizon Chemical Division of Henkel, Inc.

Triton X-102, a non-ionic octylphenol ethoxylate manufactured by Rohm & Haas Company.

Forafac 1183N, an amphoteric perfluoroalkyl surfactant, manufactured by Atochem, Inc., a 40% active solution of

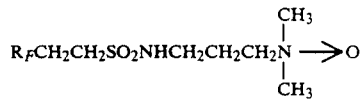

Surflon S831-2, a nonionic perfluoroalkyl surfactant manufactured by Asahi Glass Co.

Butyl Carbitol-1-butoxyethoxy-2-ethanol manufactured by Union Carbide Co.

NTA/$Na_3$=Nitrilo trisacetic acid trisodium salt manufactured by W.R. Grace Co.

Tris Amino - Tris (hydroxymethyl) amino methane manufactured by Angus Chemical Co.

IDC 810M, an imidazoline dicarboxylate amphoteric surfactant, sold by Mona Industries under the tradename "Monateric CCMM-40".

Givgard G-4-40, 40% active solution of dichlorophene manufactured by Givaudan, Inc.

Each concentrate was tested in a fire laboratory using miniaturized models of full scale fire tests described below.

Mil-Spec - Mil-F-24385C - MOD Test Procedure

The liquid concentrate is tested as a premixed solution containing 3 parts of concentrate with 97 parts of water according to the following procedure.

Three liters of regular leaded gasoline, conforming to VV-G-I690 is placed into a round fire pan that is 2.69 $ft^2$ in area and 4½" deep, containing 2½" of water and ignited. After a 10 second preburn, a foam discharge delivering 0.108 gpm of solution is directed for 90 seconds over the center of the fire pan in a spray type pattern that produces a foam quality that conforms to requirement 4.7.5 of Mil-F-24385C. Immediately after the 90 second foam application, a jet (5/32" diameter) of propane gas is ignited and placed over the center of the foam blanket at the rate of 40 cc/m. metered by a full view Rotameter model 8900D, manufactured by Brooks Instrument Div. Emerson Electric Co., King of Prussia, Pa., or equivalent. The impingement of the propane flame commences two inches above the top of the tank and shoots downwardly over the foam blanket until 25% of the foam blanket has been consumed by fire. The resulting heat flux is monitored and recorded by means of a water cooled calorimeter such as model C-1301-A-15-072 manufactured by Hy-Cal-Engineering, Santa Fe Springs, Calif., or equivalent, and a suitable Strip Chart Recorder capable of handling 1–5 M.V.

The time required to completely extinguish the fire and the time required for the propane jet to destroy 25% of the foam blanket are recorded as "Extinguishment" and "Burnback" times respectively. This test is a model of the 50 ft2 fire test in U.S. Military Specification Mil-F-24385C.

U.L. 162 5th Edition - MOD Test Procedure

Isopropyl Alcohol Test

The liquid concentrate is tested as a premixed solution containing 6 parts of foam concentrate and 94 parts of water. 15 liters of 99% isopropyl alcohol is placed into a round pan that is 2.69 $ft^2$ in area and 4½" deep, and ignited. After one minute of free burning a foam discharge delivering 0.269 gpm's of solution is directed onto the far wall of the fire pan in a solid stream application for two minutes, (Type II Fixed Nozzle) application that produces a foam quality that conforms to UL 162 5th edition paragraphs 15–15.9. Immediately after the two minute foam application, a jet (5/32" diameter) of propane gas is ignited and discharged over the center of the foam blanket at the rate of 100 cc/m. metered by a full view Rotameter, Model 8900D as manufactured by Brooks Instrument Div. Emerson Electric Co., King of Prussia, PA or equivalent.

The impingement of the propane flame commences two inches above the top of the tank and shoots downwardly over the foam blanket. The resulting heat flux is monitored and recorded by means of a water cooled Calorimeter such as Model C-1301-A-15072 manufactured by Hy-Cal-Engineering, Santa Fe Springs, California, or equivalent and a suitable Strip Chart Recorder capable of handling 1–5 MV until 20% of the foam blanket has been consumed by fire.

This test is a model of the fire test described in UL 162 5th Edition. The time required for 90% control, extinguishment and 20% burnback are recorded.

UL 162 5th Edition MOD Test Procedure

Heptane Test

The liquid concentrate is tested as a premixed solution containing 3 parts of concentrate and 97 parts of water. The test equipment is the same as that used for the isopropyl alcohol test. The procedures differ in that the foam application is Type III, the fuel is n-heptane, the application rate is 0.108 gpm and the application time is 2 minutes. The times for 90% control and 20% burnback are recorded.

The concentrates were prepared according to standard practice, that is simply blending the materials in a mixer.

Example I

| | Materials | A | B | 500 ml C |
|---|---|---|---|---|
| 1. | Water | 226 ml | 242 ml | 242 ml |
| 2. | Forafac 1157N | 33.8 g | 33.8 g | 33.8 g |
| 3. | Forafac 1183N | 16.9 g | 16.9 g | 16.9 g |
| 4. | Butyl carbitol | 67.4 ml | 67.4 ml | 67.4 ml |
| 5. | IDC-810M | 66.6 ml | | |
| 6. | Sodium decylsulfate (30%) | 83.2 ml | 83.2 ml | 83.2 ml |
| 7. | Triton X-102 | 4.2 ml | 4.2 ml | 4.2 ml |
| 8. | $MgSO_4$ | 2.0 g | 2.0 g | 2.0 g |
| 9. | Sodium benzoate | 2.0 g | 2.0 g | 2.0 g |
| 10. | Tolyl triazole | 0.5 g | 0.5 g | 0.5 g |
| 11. | APG 300 (light) | — | 50 g | — |
| | (dark) | — | — | 50 g |
| 12. | Acetic acid to adjust to pH 7.4–7.8 | | | |

Fire Test Results

| 3% sea water on 3 liters gasoline | | | | Modified Mil-F-24385C | 0.04 gpm 2.69 $ft^2$ tank |
|---|---|---|---|---|---|
| | Total Seconds | Ext. | 25% Burnback | Exp | QDT |
| A. | 106 | 0'51" | 4'25" | 10.29 | 2'30" |
| B. | 87 | 0'38" | 5'30" | 10.74 | 2'42" |
| C. | 90 | 0'42" | 7'00" | 10.56 | 2'58" |
| Spec | | 0'50" max | 5'00" min | | |

Exp = Expansion ratio of foam
QDT = 25% drainage time of foam

Composition A of Example 1 was the control. In inventive formulations B and C, the standard amphoteric surfactant IDC-810M was deleted and the alkyl polyglycoside APG 300 light (b) and dark (c) substituted therefor. Compositions B and C demonstrated better results were achieved with the formulations of the invention. THe extinguishing times (Ext.) for compositions B and C were quicker and the burnback times were longer.

Example 2

| | Materials | A | B | 1 liter C |
|---|---|---|---|---|
| 1. | Water | 751 ml | 757 ml | 753 ml |
| 2. | Urea | 12.4 g | 12.4 g | 12.4 g |
| 3. | Butyl carbitol | 39 ml | 39 ml | 39 ml |
| 4. | K8A13 | 11.3 g | 10.2 g | 9.0 g |
| 5. | G-4-40 | 2.9 g | 2.9 g | 2.9 g |
| 6. | Forafac 1157N | 46.6 g | 41.4 g | 46.6 g |
| 7. | APG-325 | 80 g | 80 g | 80 g |
| 8. | Sodium decylsulfate (30%) | 113 ml | 113 ml | 113 ml |
| 9. | $MgSO_4$ | 5.0 g | 5.0 g | 5.0 g |
| 10. | $NTA/Na_3$ | 1.6 g | 1.6 g | 1.6 g |
| 11. | Acetic Acid/50% NaOH | | | |

-continued to adjust pH 7.6–8.00

Fire Test Results
Modified UL-162
3% Seawater on 10 Liters Heptane

| | Exp. | QDT | 90% Control | Ext. | 0.04 gpm 2.69 ft² tank 20% Burnback |
|---|---|---|---|---|---|
| A | 7.42 | 7'48" | 0'35" | — | 4'45" |
| B | 7.47 | 6'46" | 0'33" | — | 5'00" |
| C | 7.95 | 6'39" | 0'45" | — | 4'45" |
| Spec | 3.5 min | 2'00" min | 0'50" max | N/A | 3'00" min |

6% Seawater on 15 Liters IPA

| | | | | | | 0.10 gpm 2.69 ft² tank |
|---|---|---|---|---|---|---|
| A | 6.47 | 23'01" | 1'06" | 1'15" | 1'51" | 7'00" |
| B | 6.10 | 25'25" | 0'38" | 1'12" | 1'47" | 6'45" |
| C | 5.66 | 19'53" | 0'48" | 1'10" | 1'55" | 6'05" |
| Spec | 7.0 min | 10'00" min | 1'15" max | 1'45" max | 2'00" max | 5'00" max |

In Example 2, Composition A was the control. The polysaccharide K8A13 and the perfluorosurfactant were reduced 10% in Composition B and the polysaccharide K8A13 was reduced 20% in Composition C. With the presence of the alkyl polyglycoside the compositions of the invention still had satisfactory performances.

Example 3

| | Materials | A | B | 1 gallon C |
|---|---|---|---|---|
| 1. | Water | 2201 ml | 2245 ml | 2092 ml |
| 2. | Surflon S-831-2 | 12 g | 10 g | 9.6 g |
| 3. | Butyl carbitol | 200 ml | 200 ml | 200 ml |
| 4. | Ethylene glycol | 220 ml | 220 ml | 220 ml |
| 5. | Forafac 1157N | 284 g | 242 g | 227.2 g |
| 6. | APG-325 | 488 g | 488 g | 586 g |
| 7. | Triton X-102 | 44 ml | 44 ml | 53 ml |
| 8. | NTA/$Na_3$ | 6 g | 6 g | 6 g |
| 9. | Tris Amino | 12.5 g | 12.5 g | 12.5 g |
| 10. | Urea | 12.5 g | 12.5 g | 12.5 g |
| 11. | Sodium decylsulfate (30%) | 305 ml | 305 ml | 336 ml |
| 12. | Acetic Acid to adjust pH to 7.6–8.0 | 8.00 | 8.00 | 7.96 |

Fire Tests Results
Modified Mil Spec
3% Seawater on 3.0 liters gasoline

| | Total Seconds | Ext. | 25% Burnback | 0.04 gpm 2.69 ft² tank Exp. | QDT |
|---|---|---|---|---|---|
| A | 98 | 0'43" | 4'27" | 8.04 | 2'22" |
| B | 79 | 0'37" | 4'58" | 7.23 | 2'39" |
| C | 88 | 0'38" | 4'30" | 7.20 | 2'48" |

1.5% Seawater on 3.0 liters gasoline

| | | | | 0.07 gpm 2.69 ft² tank | |
|---|---|---|---|---|---|
| A | 79 | 0'36" | 7'43" | 4.05 | 2'12" |
| B | 67 | 0'34" | 7'07" | 4.15 | 2'24" |
| C | 70 | 0'36" | 6'40" | 4.37 | 2'18" |

In Example 3, composition A was the control. In composition B, the perfluoro surfactants were decreased, the poly alkylglycoside remained the same. In the composition C, the poly alkylglycoside was increased and the perfluoro surfactants further decreased. Testing according to th e modified test Mil-F-24385C as described above for Example 1, equal or better results were achieved with the compositions of the inventions.

Example 4

| | Materials | A | B | 1 liter C |
|---|---|---|---|---|
| 1. | Water | 804 ml | 804 ml | 804 ml |
| 2. | Butyl carbitol | 38 ml | 38 ml | 38 ml |
| 3. | Xanthan gum | 13.2 g | 10.9 g | 8.5 g |
| 4. | G-4-40 | 2.5 g | 2.5 g | 2.5 g |
| 5. | Forafac 1157N | 47.8 g | 47.8 g | 47.8 g |
| 6. | APG-325 | 44.0 g | 44.0 g | 44.0 g |
| 7. | Sodium decylsulfate | 79 ml | 79 ml | 79 ml |
| 8. | NTA/$Na_3$ | 1.6 g | 1.6 g | 1.6 g |
| 9. | Tris Amino | 1.6 g | 1.6 g | 1.6 g |
| 10. | Acetic Acid to adjust pH to 7.6–8.0 | | | |

| | | | | |
|---|---|---|---|---|
| Viscosity | 3 RPM | 33,200 cps | 23,440 cps | 15,360 cps |
| Curves | 6 RPM | 17,280 cps | 12,480 cps | 8,440 cps |
| Brookfield | 12 RPM | 8,900 cps | 6,460 cps | 4,590 cps |
| Sprindle 3 at | 30 RPM | 3,884 cps | 2,848 cps | 2,024 cps |
| | 60 RPM | off scale | 1,608 cps | 1,118 cps |

Fire Test Results
Modified UL-162
3% Seawater on 10 Liters Heptane

| | Exp. | 25% drain | 90% Control | Ext. | 20% Burnback | 0.04 gpm 2.69 ft² tank |
|---|---|---|---|---|---|---|
| A | 7.3 | 6'42" | 0'37" | — | 3'59" | |
| B | 7.58 | 7'35" | 0'37" | — | 5'00" | |
| C | 6.97 | 4'20" | 0'37" | — | 4'20" | |
| Spec | 3.5 min | 2'00" min | 0'50" max | N/A | 3'00" min | |

6% Seawater on 15 Liters IPA (99%)

| | | | | | | 0.10 gpm 2.69 ft² tank |
|---|---|---|---|---|---|---|
| A | 9.83 | 20'46" | 0'42" | 1'05" | 8'15" | |
| B | 9.79 | 17'05" | 0'38" | 0'56" | 9'00" | |
| C | 9.67 | 13'10" | 0'30" | 0'53" | 7'30" | |
| Spec | 7.0 min | 10'00" min | 1'15" max | 1'45" max | 2'00" max | 5'00" min |

| | | | | |
|---|---|---|---|---|
| Viscosity | 3 RPM | 33,200 cps | 23,440 cps | 15,360 cps |
| Curves | 6 RPM | 17,280 cps | 12,480 cps | 8,440 cps |
| Brookfield | 12 RPM | 8,900 cps | 6,460 cps | 4,590 cps |
| Sprindle 3 at | 30 RPM | 3,884 cps | 2,848 cps | 2,024 cps |
| | 60 RPM | off scale | 1,608 cps | 1,118 cps |

Fire tests were run pursuant to the modified UL tests previously described.

Composition A was a standard ARAFFF composition. As the amount of polymer (xanthan gum) decreased the viscosity decreased. Thus, less polymer could be used with better or superior results with the presence of the alkyl polyglycoside.

Having described our invention, what we now claim is:

We claim:

1. A firefighting composition concentrate which comprises:

perfluoroalkyl surfactants, a solvent and an effective amount of alkyl polyglycoside sufficient to permit a reduction in the concentration of the perfluoroalkyl surfactant without loss of firefighting performance by the composition, said alkyl polyglycoside present in amount of between about 1.0 to 10.0% by weight.

2. The composition of claim 1 wherein the alkyl polyglycoside comprises:

$$R_1—O—R_2$$

wherein $R_1$ is a polysaccharide of the formula

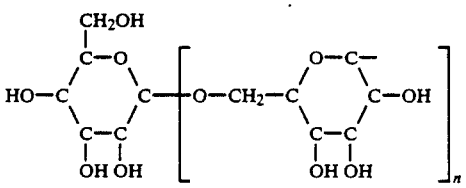

wherein n equals 1 to 5, and $R_2$ is an alkyl group of the formula ($C_nH_{2n+1}$, where n equals 4 to 18.

3. The composition of claim 1 which comprises: a water soluble polymer.

4. The composition of claims 1 or 3 wherein the perfluoroalkyl surfactants may be selected from the group consisting of anionic, cationic, non-ionic and amphoteric surfactants.

5. The composition of claims 1 or 3 which comprises: non-fluorinated surfactants.

6. The composition of claim 5 wherein the non-fluorinated surfactants are selected from the group consisting of anionic, cationic, non-ionic and amphoteric surfactants.

7. The composition of claim 1 wherein the solvent is selected from the group consisting of glycols and glycol ethers.

8. The composition of claim 3 wherein the water soluble polymer is a polysaccharide polymer.

9. The composition of claim 8, wherein the polysaccharide polymer is selected from the group consisting of xanthan gum, gum tragacanth, locust beam gum or guar gum.

10. The composition of claim 9 wherein the perfluoroalkyl surfactants are present in an amount of 0.5 to 3% by weight.

11. The composition of claim 3 wherein the water soluble polymer is present in an amount of 0.5 to 1.5%.

* * * * *